US008998525B2

(12) United States Patent
Rolion et al.

(10) Patent No.: US 8,998,525 B2
(45) Date of Patent: Apr. 7, 2015

(54) STRUCTURE FOR MOUNTING A CLIP FOR A WRITING IMPLEMENT

(75) Inventors: Franck Rolion, Asnieres sur Oise (FR); Laurent Beaucher, Saint Maur des Fosses (FR)

(73) Assignee: Societe BIC, Clichy (FR)

( * ) Notice: Subject to any disclaimer, the term of this patent is extended or adjusted under 35 U.S.C. 154(b) by 321 days.

(21) Appl. No.: 13/063,442

(22) PCT Filed: Sep. 9, 2009

(86) PCT No.: PCT/FR2009/051698

§ 371 (c)(1),
(2), (4) Date: Mar. 10, 2011

(87) PCT Pub. No.: WO2010/029256

PCT Pub. Date: Mar. 18, 2010

(65) Prior Publication Data

US 2011/0180677 A1 Jul. 28, 2011

(30) Foreign Application Priority Data

Sep. 10, 2008 (FR) ..... 08 56078

(51) Int. Cl.
*B43K 23/12* (2006.01)
*B43K 25/02* (2006.01)

(52) U.S. Cl.
CPC ..... *B43K 25/022* (2013.01); *B43K 23/126* (2013.01)

(58) Field of Classification Search
CPC ..... B43K 25/022; B43K 23/126
USPC ..... 401/104–106, 109, 202, 243–247; 24/11 F; 248/223.31, 223.41, 223.51, 248/224.51, 224.61, 224.7
See application file for complete search history.

(56) References Cited

U.S. PATENT DOCUMENTS 6,966,718 B2 11/2005 Furukawa et al.

FOREIGN PATENT DOCUMENTS

| | | | | |
|---|---|---|---|---|
| DE | 75 35 192 U | | 3/1976 | |
| DE | 77 35 114 U1 | | 3/1978 | |
| JP | 51061936 U | | 7/1949 | |
| JP | 2005-074823 | | 3/2005 | |
| JP | 2006-289725 A | * | 10/2006 | ..... B43K 25/00 |
| JP | 2007-276198 A | * | 10/2007 | ..... B43K 25/00 |
| JP | 02010083070 A | * | 4/2010 | ..... B43K 25/00 |

OTHER PUBLICATIONS

French Preliminary Search Report of FR 0856078.
International Search Report of WO 2010/029256 A1.

* cited by examiner

*Primary Examiner* — Gwendolyn Baxter
(74) *Attorney, Agent, or Firm* — Jones Day

(57) ABSTRACT

A structure for mounting a clip for a writing implement which has a barrel extending along a longitudinal axis. The structure includes a fastening member made of plastic material integral with the barrel and having a proximal wall and a distal wall with respect to the barrel, the proximal and distal walls being arranged opposite each other and overall extending in substantially parallel respective planes in order to form between them a recess having an open insertion end. The clip includes a fastening portion having a substantially uniform thickness and is suitable for mounting in the recess by the open insertion end.

11 Claims, 2 Drawing Sheets

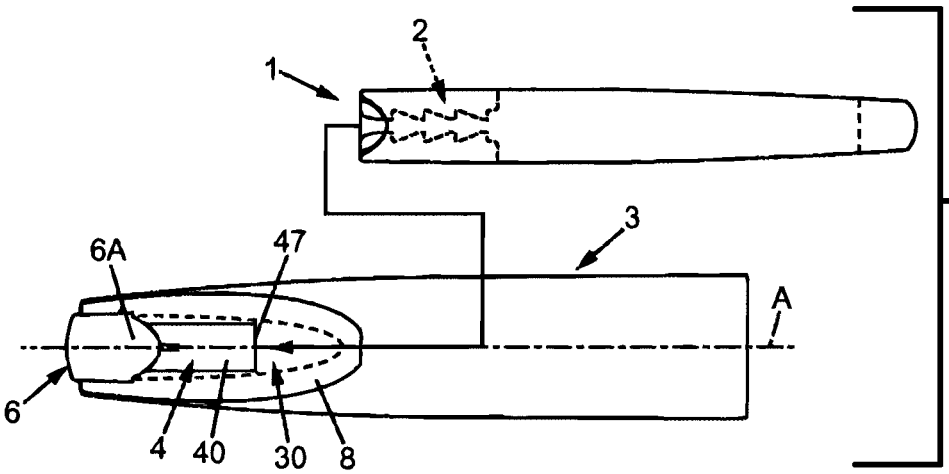
FIG. 1
FIG. 2
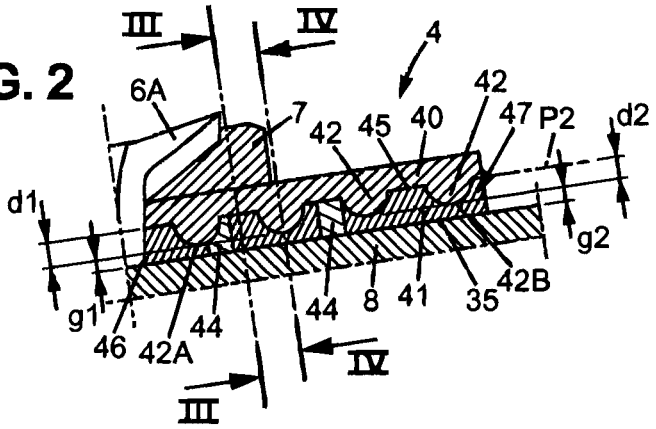
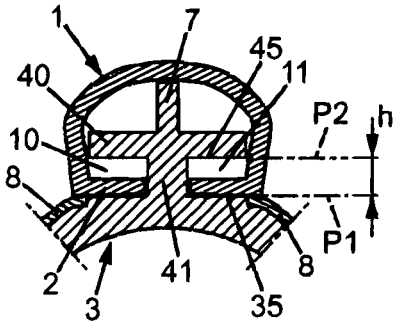
FIG. 3
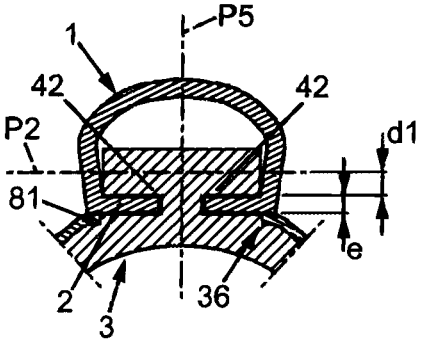
FIG. 4

STRUCTURE FOR MOUNTING A CLIP FOR A WRITING IMPLEMENT

CROSS REFERENCE TO RELATED APPLICATION

This application is a national stage application of International Application No. PCT/FR2009/051698, filed on Sep. 9, 2009, which claims the benefit of French Patent Application No. 0856078 filed on Sep. 10, 2008, the entire contents of both applications being incorporated herein by reference.

FIELD OF INVENTION

The embodiments of the present invention generally relate to a structure for mounting a clip for a writing implement having a barrel extending along a longitudinal axis, that includes a fastening member made of plastic material integral with the barrel, that includes a proximal wall and a distal wall with respect to the barrel arranged opposite each other and essentially extending in substantially parallel planes respectively, in order to form between them a recess which has an open insertion end. The clip also includes a fastening portion that has a substantially uniform thickness and is suitable for mounting in the recess via the open insertion end.

BACKGROUND OF THE INVENTION

Such a mounting structure is known in particular from the Japanese utility model JP51061936U. The fastening member has a T-shaped cross-section. The clip produced from a metal sheet has a rear portion, C-shaped in cross-section, which is folded inwards in order to form a fastening portion engaging in two recesses each provided between two parallel walls of the fastening member. The width of each recess is substantially uniform and equal to the thickness of the sheet, which keeps the fastening portion on the fastening member in the radial direction, i.e. perpendicular to the parallel walls.

However, the device described in Japanese utility model JP51061936U presents drawbacks. In particular, the engagement of the fastening portion in the recesses of the fastening member require the rear end of the clip to be accurately positioned against the front end of the fastening member, then the clip has to be pushed in translational motion until the fastening portion is fully inserted. This operation is generally carried out manually and proves to be relatively awkward. In fact, it is not easy to achieve the required axial alignment of the clip vis-à-vis the recesses, which increases the time required for mounting. In addition, the fastening portion of the clip is in more or less close contact with the parallel walls of the recesses, depending on the thickness of the clip or the width of the recesses which can vary due to manufacturing tolerances. This generates either significant adhesion forces or an insufficient hold on the clip. Adhesion forces which are too high interfere with mounting the clip, and in particular there is a risk of damaging the fastening member at the start of the engagement of the fastening portion if it deviates from the required axial alignment.

SUMMARY OF THE EMBODIMENTS OF THE PRESENT INVENTION

The embodiments of the present invention aim to resolve these drawbacks. To do this, the embodiments of the invention aim to provide a mounting structure for a writing implement which allows at least partial mounting of a clip, manually and without difficulty, in the required axial alignment with respect to a fastening member integral with a barrel. "Partial mounting" means a provisional mounting position of the clip where it is positioned on the fastening member in the required axial alignment in a predetermined and relatively stable fashion, although it is not completely mounted.

To this end, a subject of the embodiments of the invention is a writing implement as defined generally above, characterized in that at least one of the proximal and distal walls comprises a plurality of bosses projecting towards the inside of the recess, at least one first boss having a first apex provided at a first distance from the wall adapted so that the first apex makes contact with the fastening portion, and at least one second boss of the wall, arranged between the first boss and the open insertion end has a second apex provided at a second distance from the wall that is less than the first distance.

Due to these arrangements, the fastening portion of the clip is not in contact with a second boss, while having a suitable thickness so that contact with at least one first boss allows the clip to be held in the radial direction. In other words, there is no pinching of the fastening portion of the clip between a second boss and the (flat or embossed) opposite wall, and therefore no resistance of at least one second boss to the mounting of the clip. This facilitates the manual mounting of the clip as far as a predetermined provisional position which corresponds for example to each fastening edge of the clip coming into contact with a first boss.

In this way, the clip mounted provisionally in a relatively stable fashion on the fastening member can be positioned in an easily reproducible manner in a mounting tool suitable for finishing the mounting. Such a mounting tool, which is not part of the embodiments of the present invention, is provided in order to exert on the clip a sufficient force in the required axial direction to move it in translational motion from the predetermined provisional position to the definitive mounting position on the fastening member. During this movement of the clip, the fastening portion of the clip comes into contact with at least one first apex, which allows the clip to be firmly held on the fastening member in the radial direction.

In other preferred embodiments of the writing instrument according to the embodiments of the invention, one or other of the following arrangements is used: the proximal and distal walls are connected together by a central partition which is substantially perpendicular to them and extends in a radial plane, the central partition separating the recess into two laterally opposite parts; the proximal wall has a flat surface; the first apex is arranged at a third distance from the proximal wall at the most equal to the thickness of the fastening portion; the second apex is arranged at a fourth distance from the proximal wall greater than the thickness of the fastening portion; the distal wall has at least two first bosses and at least two second bosses; the proximal and distal walls each have at least one boss, the respective apexes of the bosses of the proximal and distal walls being arranged so that the first apex is distant from an apex on the opposite wall by a fifth distance in the radial direction at the most equal to the thickness of the fastening portion; the bosses each extend in a direction substantially perpendicular to the central partition and each have a uniform section in this direction; the fastening portion comprises two opposite fastening edges on either side of a slot which extends longitudinally, each fastening edge having a profile which has at least one gap, and the central partition has two opposite side walls each having at least one lateral boss projecting perpendicularly to the partition, each lateral boss being suitable for engaging in one of the gaps, which makes it possible to prevent the clip from performing a reverse translational movement to the mounting direction unless a pulling force greatly exceeding the scope of normal use is exerted on the clip; a lateral boss is provided between a first apex and a second apex close to the first apex; the recess is constituted by a laterally closed gap part, and the clip has a fastening portion with a U-shaped section.

BRIEF DESCRIPTION OF THE DRAWINGS

Other characteristics and advantages will become apparent from the following description of non-limitative examples of embodiments of the present invention, with reference to the figures, in which:

FIG. 1 diagrammatically represents a top view of a first embodiment of a mounting structure according to the embodiments of the invention, together with a clip provided for mounting on a cap via the mounting structure.

FIG. 2 diagrammatically represents the mounting structure of FIG. 1 in a partial side view with the clip not shown.

FIG. 3 diagrammatically represents a partial cross-section view of the mounting structure in the plane III-III of FIG. 2 with the clip mounted on the fastening member.

FIG. 4 diagrammatically represents a partial cross-section view of the mounting structure in the plane IV-IV of FIG. 2 with the clip mounted on the fastening member.

DETAILED DESCRIPTION OF THE EMBODIMENTS OF THE PRESENT INVENTION

Figure 5:
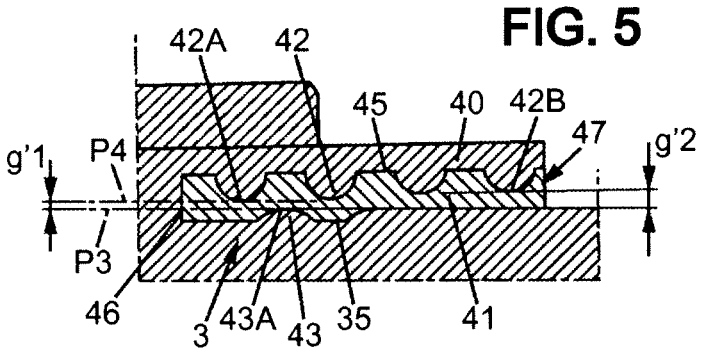
FIG. 5 diagrammatically represents a second embodiment of a mounting structure according to the embodiments of the invention, in which the lower and upper walls of the fastening member both have bosses.

The mounting structure shown in the top view in FIG. 1 comprises a fastening member 4 integral with an outer tubular portion 3 of the writing implement extending along a longitudinal axis A. In the following, the term barrel will be used to denote this outer tubular portion 3, but it is understood that this term is meant in the broadest sense and also applies to a tubular portion of a cap. The fastening member 4 comprises an upper portion 40 which is distal with respect to the barrel 3, a lower portion 30 which is proximal with respect to the barrel, these two parts between them providing a recess in the radial direction which has an open insertion end 47 for a clip 1. The clip 1 is typically produced from a metal sheet and comprises a fastening portion 2 having a C-shaped section with opposite edges 20 shaped as saw teeth 21 separated by a median slot 9 as can be seen in more detail in FIG. 6.

The fastening portion 2 has a substantially uniform thickness and is suitable for mounting in the recess of the fastening member 4 by the insertion end 47. On the side opposite to the insertion end 47, the fastening member 4 is delimited by a projecting prominent portion 6A extending a closed end portion 6 of the barrel 3 in the direction of the insertion end 47. This prominent portion 6A is provided in order to form a surface continuity with an outer surface of the clip 1 and to constitute a stop to prevent translational motion of the clip towards the closed end 6.

As shown in FIGS. 2 and 3, the upper portion 40 of the fastening member has a wall 45 arranged opposite to a wall 35 formed by a flat surface of the lower portion 30 of the fastening member. As the wall 45 is further from the barrel 3 than the wall 35, the walls 45 and 35 are called the distal wall and the proximal wall respectively. The distal wall 45 has flat portions extending in a plane P2 substantially parallel to a plane P1 in which the proximal wall 35 extends, which is itself completely flat, and has moreover a plurality of bosses 42 projecting towards the proximal wall 35. Each boss 42 has the shape of a cylinder truncated in a plane parallel to its axis, which is advantageous for the simplicity of moulding as a mould forming several bosses can be removed in the direction of the axes of the bosses, these axes being parallel to planes P1 and P2 and perpendicular to the longitudinal axis A. However, it is understood that the embodiments of the invention is not limited to this shape of bosses.

The plurality of bosses comprises two types of bosses, namely a first type constituted by at least one first boss having a first apex 42A arranged at a first distance d1 from the wall and a second type constituted by at least one second boss having a second apex 42B arranged at a second distance d2 from the wall, the second distance being less than the first distance. Each second boss is arranged between a first boss and the insertion end 47.

The embodiment shown comprises two first bosses and two second bosses, but it is understood that it is possible to provide a single boss or more than two bosses of each type. Each first apex 42A is situated at a third distance g1 from the proximal wall 35 which is at the most equal to the thickness of the fastening portion 2 of the clip 1. Preferably, taking account of the manufacturing tolerances of the fastening member 4 in plastic material and optionally of those of the clip 1 (generally much narrower for manufacture in metal), the upper authorized tolerance value for the third distance g1 is provided as equal to the lower authorized value for the thickness of the fastening portion 2, so that there can be no radial play of the fully-mounted fastening portion 2 on the fastening member 4.

The plastic material used for the manufacture of the fastening member 4, for example in polypropylene, is relatively hard and not very compressible, but a small compression of the first bosses typically of the order of a few hundredths of a millimeter is possible without weakening the fastening member in order if necessary to absorb the small excess thickness of the fastening portion 2 with respect to the effective distance g1. In this way, the fastening portion 2 is more or less pinched radially by the first bosses against the proximal wall 35, ensuring that the clip is held without play in the radial direction. Nevertheless, this pinching remains weak or virtually zero, and therefore the complete insertion of the fastening portion 2 into the recess of the fastening member 4 is carried out without requiring undue effort to overcome the adhesion forces. In comparison, a device of the state of the art such as mentioned in the introduction does not make it possible to absorb a possible excess thickness of the sheet of the clip with respect to the uniform width of a recess of the fastening member, and such an excess thickness would lead to difficult insertion of the clip with the risk of twisting it or causing a break in the fastening member.

As regards the second bosses of the distal wall 45, they do not ensure a firm hold on the clip in the radial direction, as each second apex 42B is situated at a fourth distance g2 from the proximal wall 35 which is greater than the thickness of the fastening portion 2. The difference between this distance g2 and the thickness is for example of the order of 1 tenth of a millimeter. In this way, the second bosses do not pinch the clip and therefore do not create adhesion forces on the fastening portion 2, but nevertheless allows a relatively stable positioning of the clip so as to provide a provisional mounting position in which the clip is in the required axial alignment with respect to the fastening member 4.

The distal wall 45 is connected to the proximal wall 35 by a central partition 41 extending in a radial plane which passes through the longitudinal axis A. This central partition separates the recess of the fastening member 4 into two laterally opposite parts 10, 11 in the form of grooves symmetrical with respect to the radial plane. The parallel axes of the truncated cylinders which form the bosses 42 are substantially perpendicular to the central partition 41.

Figure 6:
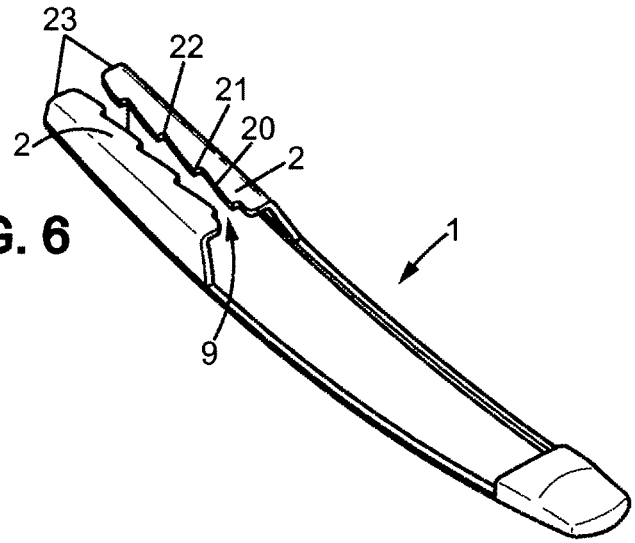
FIG. 6 represents a perspective bottom view of the clip of FIG. 1.

Advantageously, the central partition 41 has two opposite side walls each of which has at least one lateral boss 44 projecting perpendicularly to the partition. Each lateral boss 44 has the shape of a cylinder truncated in a plane parallel to its axis, this axis being perpendicular to planes P1 and P2, and is suitable for engaging in a gap 22 of a fastening edge 20 of the fastening portion 2 of the clip as can be seen in FIG. 6.

It is understood that the fastening portion 2 has some elasticity in the transversal direction due to the C-shaped section of the clip in this direction, in order to allow the insertion of the lateral bosses 44 into the median slot 9 of the fastening portion 2. Each lateral boss 44 is arranged between a first apex 42A and a second apex 42B close to the first apex 42A, i.e. there is no lateral boss between a second apex 42B and the insertion end 47. This ensures that during mounting the fastening edges 20 of the clip do not come into contact with the lateral bosses until the predetermined provisional mounting position has been reached.

The surface of the lateral boss 44 situated closest to the insertion end 47 preferably has a radius of curvature less than the radius of curvature of the surface of a lateral boss further from this end 47. On the side opposite to the insertion end 47, each recess portion 10 or 11 is closed by an end wall 46 which extends radially towards the prominent portion 6A. At the front of this portion 6A, a ridge-shaped portion 7 extends radially towards the outside the central partition 41, and serves as a stop to prevent radial penetration of the clip.

In the embodiment shown, the fastening member 4 and the barrel 3 are produced as a single piece by sandwich injection moulding and which has an outer layer 8 formed by one of the two materials. As can be seen in FIGS. 3 and 4, this outer layer 8 has a central opening defining an inner edge 81 abutting a shoulder 36 of the proximal wall 35, this inner edge being in close contact with the fastening portion 2. This embodiment has the advantage of allowing the use of a material for the outer layer 8 the adhesion of which with the other material is not necessarily high, as this layer 8 is not subjected to traction in order to retain the clip. However, according to another embodiment, not shown, also using sandwich injection moulding, it can be provided for the fastening member 4 to be moulded in the same material as the outer layer 8 if the adhesion between the two materials is sufficiently high to prevent the risk of separation of this layer 8 following use of the clip.

As can be seen in FIG. 3, the space h between planes P1 and P2 in which the proximal wall 35 and the distal wall 45 respectively extend is envisaged as of the order of 2 to 4 times the thickness e of the fastening portion 2 of the clip.

As can be seen in FIG. 4, in each recess portion 10 or 11, each first boss 42 holds the fastening portion 2 in the radial direction, and it is understood that in comparison with FIG. 3 the space h is equal to the sum of the thickness e of the fastening portion 2 and the height d1 of a first boss 42.

The second embodiment shown in FIG. 5 differs from the first embodiment in that the proximal wall 35 of the fastening member has an embossed portion. This embossed portion here has two gaps on both sides of a boss 43 the apex of which 43A is arranged opposite to a gap separating two first bosses 42 on the distal wall 45. In order to simplify matters, the lateral bosses 44 of FIG. 2 are not shown in FIG. 5, but it is understood that this second embodiment advantageously comprises such bosses. The apex 43 A is at a tangent to a first apical plane P3 in which a flat portion of the proximal wall 35 extends, and the two first apexes 42 A are at a tangent to a second uppermost plane P4 parallel with the first uppermost plane P3. The two uppermost planes P3 and P4 are separated by a distance g'1 substantially equal to the thickness e of the fastening portion 2. Thus, the fastening portion 2 is pinched against the proximal wall 35 mainly at the level of the apex 43A. As a result, in this second embodiment, the surfaces of the fastening member 4 in contact with the fastening portion 2 are reduced with respect to the first embodiment, which also allows a further reduction in the adhesion forces created by the pinching of the fastening portion 2 and therefore a reduction in the force needed for mounting the clip.

The clip 1 shown in perspective in FIG. 6 is adapted from the previous embodiments. Preferably, two edges of the rear end 23 of the fastening portion 2 are arranged in order to each abut against the end wall 46 of a recess portion 10 or 11 when the clip is completely mounted.

Figure 7:
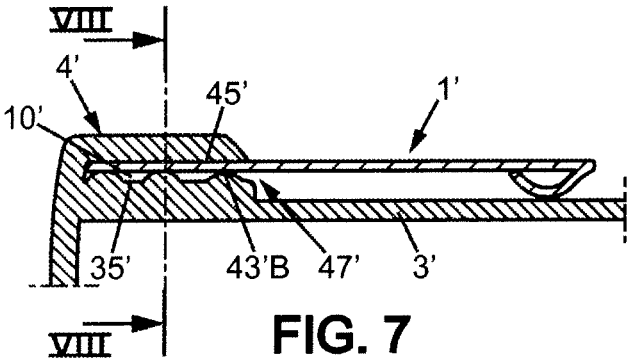
FIG. 7 diagrammatically represents a third embodiment of a mounting structure according to the embodiments of the invention, in which the recess of the fastening member of the structure is closed laterally.
Figure 8:
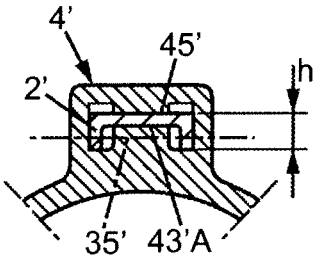
FIG. 8 diagrammatically represents a partial cross-section view of the mounting structure in the plane VIII-VIII of FIG. 7 with the clip mounted on the structure.

The third embodiment shown in FIGS. 7 and 8 differs from the two previous embodiments essentially in that the clip 1' has a fastening portion 2' of U-shaped section, and in that the recess 10' of the fastening member 4' is constituted by a gap portion which is laterally closed and open at the level of an insertion end 47' by which the fastening portion of the clip 1' is inserted into the mounting so as to be surrounded by the fastening member. The fastening member 4' comprises a flat distal wall 45' and a proximal wall 35' having flat portions extending in a plane substantially parallel to the distal wall 45'.

The proximal wall 35' has two first bosses each having a first apex 43'A and a second boss the second apex 43'B of which is closer to the proximal wall 35' than the first apexes 43'A. The distance between each first apex 43'A and the distal wall 45' is at the most equal to the thickness of the fastening portion 2', so as to provide a more or less significant pinching of the fastening portion. The fastening portion 2' has two flanks which correspond to the legs of the U-shaped section and are orientated towards the barrel 3'.

Preferably, each flank extends over a height h at the most equal to the extent of the recess 10' in the radial direction and each has an end edge shaped as saw teeth, in order to improve the resistance to the removal of the clip 1'.

In other embodiments which are not shown, it can be provided for the distal wall 45' to have bosses, and in this case it is moreover possible to provide a completely flat proximal wall 35'.

The invention claimed is:

1. A structure for mounting a clip for a writing implement which has a barrel extending along a longitudinal axis, comprising:

a fastening member made of plastic material integral with the barrel, having a proximal wall and a distal wall with respect to the longitudinal axis of the barrel, the proximal and distal walls being arranged opposite each other and overall extending in substantially parallel respective planes in order to form between them a recess having an open insertion end;

a clip including a fastening portion having a substantially uniform thickness and suitable for mounting in the recess by the open insertion end;

wherein at least one of the proximal and distal walls includes a plurality of bosses projecting towards the inside of the recess, at least one first boss among the plurality of bosses has a first apex arranged at a first radial distance with respect to the longitudinal axis of the barrel from the wall from which the first boss projects, the first radial distance being adapted so that the first apex makes contact with the fastening portion, and at least one second boss of the wall from which the first boss projects is arranged between the first boss and the open insertion end, the second boss having a second apex arranged at a second radial distance with respect to the longitudinal axis of the barrel from the wall from which the first boss projects, the second radial distance being less than the first distance, wherein the clip is maintained radially in the fastening member by the first boss.

2. The mounting structure according to claim 1, wherein the proximal and distal walls are connected together by a central partition which is substantially perpendicular to them and extends in a radial plane, the central partition separating the recess in two laterally opposite parts.

3. The mounting structure according to claim 2, wherein the bosses each extend in a direction substantially perpendicular to the central partition and each have a uniform section in this direction.

4. The mounting structure according to claim 2, wherein the fastening portion comprises two opposite fastening edges on either side of a slot which extends longitudinally, each fastening edge having a profile which has at least one gap, and the central partition has two opposite side walls each of which has at least one lateral boss projecting perpendicularly to the partition, each lateral boss being suitable for engaging in one of the gaps.

5. The mounting structure according to claim 4, wherein the lateral boss is arranged between a first apex and a second apex adjacent to the first apex.

6. The mounting structure according to claim 1, wherein the proximal wall has a flat surface.

7. The mounting structure according to claim 6, wherein the first apex is arranged at a third distance from the proximal wall, the third distance being at most equal to the thickness of the fastening portion.

8. The mounting structure according to claim 6, wherein the second apex is arranged at a fourth distance from the proximal wall greater than the thickness of the fastening portion.

9. The mounting structure according to claim 1, wherein the distal wall has at least two first bosses and at least two second bosses.

10. The mounting structure according to claim 1, wherein the proximal and distal walls each have at least one boss of the plurality of bosses, the respective apexes of the bosses of the proximal and distal walls being arranged so that the apex of the first boss of the proximal wall is at a tangent to a first uppermost plane in which a flat portion of the proximal wall extends, two first apexes of the distal wall are at a tangent to a second uppermost plane parallel with the first uppermost plane, and the first and second uppermost planes are separated by a distance in a radial direction perpendicular to the proximal and distal walls, said distance being at most equal to the thickness of the fastening portion.

11. The mounting structure according to claim 1, wherein the recess is constituted by a laterally closed gap portion, and the clip has the fastening portion of U-shaped section.

* * * * *